US006923418B2

(12) United States Patent
Hotta et al.

(10) Patent No.: US 6,923,418 B2
(45) Date of Patent: Aug. 2, 2005

(54) ENGINE AUXILIARY EQUIPMENT MOUNTING CONSTRUCTION

(75) Inventors: Naoki Hotta, Saitama (JP); Hajime Ito, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/214,690

(22) Filed: Aug. 9, 2002

(65) Prior Publication Data

US 2003/0042391 A1 Mar. 6, 2003

(30) Foreign Application Priority Data

Aug. 31, 2001 (JP) ..... P. 2001-264223

(51) Int. Cl.[7] ..... F02B 67/06
(52) U.S. Cl. ..... 248/674; 123/198 R
(58) Field of Search ..... 123/198 R; 248/674, 248/300, 200, 544, 637

(56) References Cited

U.S. PATENT DOCUMENTS 2,662,988 A * 12/1953 McKim ..... 310/91
D204,692 S * 5/1966 Neill ..... D8/380
D276,410 S * 11/1984 Taylor ..... D8/380
4,506,522 A * 3/1985 Swaney et al. ..... 62/243
D311,859 S * 11/1990 Bohringer ..... D8/380
5,636,608 A * 6/1997 Shichinohe et al. ..... 123/197.1
6,360,712 B1 * 3/2002 Banks et al. ..... 123/198 R

FOREIGN PATENT DOCUMENTS

JP 62-78343 5/1987
JP 63248930 A * 10/1988
JP 09053459 A * 2/1997
JP 09105334 A * 4/1997
JP 2001115852 A * 4/2001
JP 2002161753 A * 6/2002

* cited by examiner

*Primary Examiner*—Anita M. King
(74) *Attorney, Agent, or Firm*—Armstrong, Kratz, Quintos, Hanson & Brooks, LLP

(57) ABSTRACT

An auxiliary equipment bracket is formed into a substantially U-shaped configuration having a pair of stays which face each other with a support portion of an engine main body and a supported portion of auxiliary equipment being interposed therebetween and a connecting body which connects the two stays together, and formed in each of the respective stays are a first bolt passing hole for allowing a tightening bolt to pass through the support portion between the respective stays and a second bolt passing hole for allowing a tightening bolt to pass through the supported portion between the respective stays.

8 Claims, 4 Drawing Sheets

ENGINE AUXILIARY EQUIPMENT MOUNTING CONSTRUCTION

BACKGROUND OF THE INVENTION

1. Field of the Invention

The present invention relates to an engine auxiliary equipment mounting construction in which an engine main body and auxiliary equipment attached to an engine are connected to each other via an auxiliary equipment bracket.

2. Description of the Related Art

Conventionally known is an engine auxiliary equipment mounting construction in which an auxiliary equipment is directly mounted to an engine main body to thereby reduce the size and weight of the engine. In the auxiliary equipment mounting construction like this in which the auxiliary equipment is directly mounted to the engine, however, there is caused a problem that in many cases it becomes difficult to mount to the same engines a plurality of types of auxiliary equipments which vary depending on destinations and specifications of vehicles. In addition, there is caused another problem that the size and mounting position of the auxiliary equipment puts limitations on the layout thereof.

Then, there is known an engine auxiliary equipment mounting construction in which auxiliary equipment is designed to be connected to an engine main body via a strong auxiliary equipment bracket, whereby the problems inherent in the auxiliary equipment mounting construction in which auxiliary equipment is directly mounted to the engine can be solved simply by modifications in construction and configuration of the bracket itself (for example, refer to JP-A-62-78343U).

However, the conventional auxiliary equipment bracket is disposed between an engine main body and auxiliary equipment in such a manner as to project from the engine main body, and in order to support the auxiliary equipment stably via this bracket, a relatively large number of tightening bolts are needed, and also the bracket needs to be formed relatively large, sturdy and thick. Therefore, in addition to increase in the weight and cost of the bracket, the numbers of components and man hours for assembling need to be increased. In addition, the auxiliary equipment needs to overhang from the engine main body by an extent equal to a space taken by the bracket, and this caused a problem that the engine needs to be enlarged. In addition, this problem tends to get more remarkable as the size and weight of the bracket itself need to be increased when the rigidity and strength of the bracket are tried to be increased.

SUMMARY OF THE INVENTION

The invention was made in view of the above situations, and an object thereof is to provide an engine auxiliary equipment mounting construction which can solve the problems inherent in the conventional auxiliary equipment brackets while enjoying the original advantage (an advantage over the construction in which the auxiliary equipment is mounted directly to the engine) that would result from the construction in which the auxiliary equipment is not mounted directly to the engine main body but mounted thereto via the auxiliary equipment bracket.

With a view to attaining the object, according to a first aspect of the invention, there is provided an engine auxiliary equipment mounting construction in which a support portion provided on an engine main body and a supported portion provided on auxiliary equipment in such a manner as to be arranged in parallel with the support portion are connected to each other via an auxiliary equipment bracket, wherein the auxiliary equipment bracket is formed into a substantially U-shaped configuration having a pair of stays which extend in a direction in which the support portion and the supported portion are arranged in parallel with each other in such a manner as to face each other to hold the support portion and the supported portion therebetween and a connecting body for connecting both the stays together, and wherein a first bolt passing hole through which a tightening bolt is allowed to pass to tighten the connection between the respective stays and the support portion and a second bolt passing hole through which a tightening bolt is allowed to pass to tighten the connection between the respective stays and the supported portion are formed in each of the respective stays.

According to the first aspect of the invention, since the auxiliary equipment bracket is constituted by the pair of stays which interpose the support portion on the engine main body and the supported portion on the auxiliary equipment therebetween and which are tightened by the bolts and the connecting body which integrally connects the pair of stays at one end thereof, not only can the number of bolts that have to be used be limited to a minimum number, but also the numbers of components and man hours for assembling can be reduced largely by the construction in which the pair of stays are made to be an integral component with the connecting body being held therebetween.

In addition, since the support portion and the supported portion which is arranged in parallel with the support portion are interposed by the pair of stays from the sides thereof and are connected to be made integral with the bolts, the engine main body (the support portion) itself and the auxiliary equipment (the supported portion) itself are constructed to be part of the auxiliary bracket as well, so that the bracket can be reinforce effectively, and therefore even if the bracket is constituted by a relatively thin sheet material so as to reduce the size and weight of the bracket, the required connection strength can be secured between the engine main body and the auxiliary equipment. Moreover, according to the interposing construction of the substantially U-shaped bracket relative to the support portion and the supported portion, since most part of the bracket (the respective stays) can be made to overlap the support portion and the supported portion, the auxiliary equipment is allowed to be disposed as close to the engine main body as possible without being interrupted by the bracket, whereby the reduction in size and weight of the engine can be attained.

According to a second aspect of the invention, in addition to the advantage provided by the first aspect of the invention, there is provided an engine auxiliary equipment mounting construction as set forth in the first aspect of the invention, wherein a detent unit is provided between at least one of the stays and the engine main body for preventing the entrained rotation of the auxiliary equipment bracket that would occur when the tightening bolt is tightened to ensure the connection between the respective stays and the support portion. Thus, according to the feature of the second aspect of the invention, since the bolts can be tightened while preventing the entrained rotation of the auxiliary equipment bracket, the efficiency in the assembling work can be improved.

According to a third aspect of the invention, in addition to the advantages provided by the above aspects of the invention, there is provided an engine auxiliary equipment mounting construction as set forth in the first or second aspect of the invention, wherein the tightening bolt for tightening the connection between the respective stays and the support portion is a single through bolt which passes through the first bolt passing holes formed in the respective stays and the support portion, wherein the tightening bolt for tightening the connection between the stays and the supported portion is a single through bolt which passes through the second bolt passing holes formed in the respective stays and the supported portion, and wherein nuts are secured to one of the stays so that the respective bolts are screwed thereinto. According to the feature of the third aspect of the invention, the number of bolts that have to be used can be reduced further and the tightening work required for the respective bolts can be performed collectively, simply and quickly relative to the pair of stays. Thus, the efficiency in the assembling work can be improved and the number of components can also be reduced.

According to a fourth aspect of the invention, in addition to the advantages provided by the above aspects of the invention, there is provided an engine auxiliary equipment mounting construction as set forth in the first, second or third aspect of the invention, wherein a bent portion is formed on the connecting body for permitting a relative displacement between ends of the connecting body that would occur in association with tightening the respective bolts. According to the feature of the fourth aspect of the invention, even if the space between the pair of stays is set slightly wider in a state in which the bracket is free considering the efficiency in the assembling work, since the respective displacement at the ends of the connecting body in conjunction with tightening the bolts can be reasonably permitted through its elastic deformation, the respective stays are allowed to follow and be brought into close contact with the support portion and the supported portion easily.

DETAILED DESCRIPTION OF THE PREFERRED EMBODIMENTS

The mode for carrying out the invention will be described specifically below based on an embodiment of the invention with reference to FIGS. 1 to 5.

Figure 1:
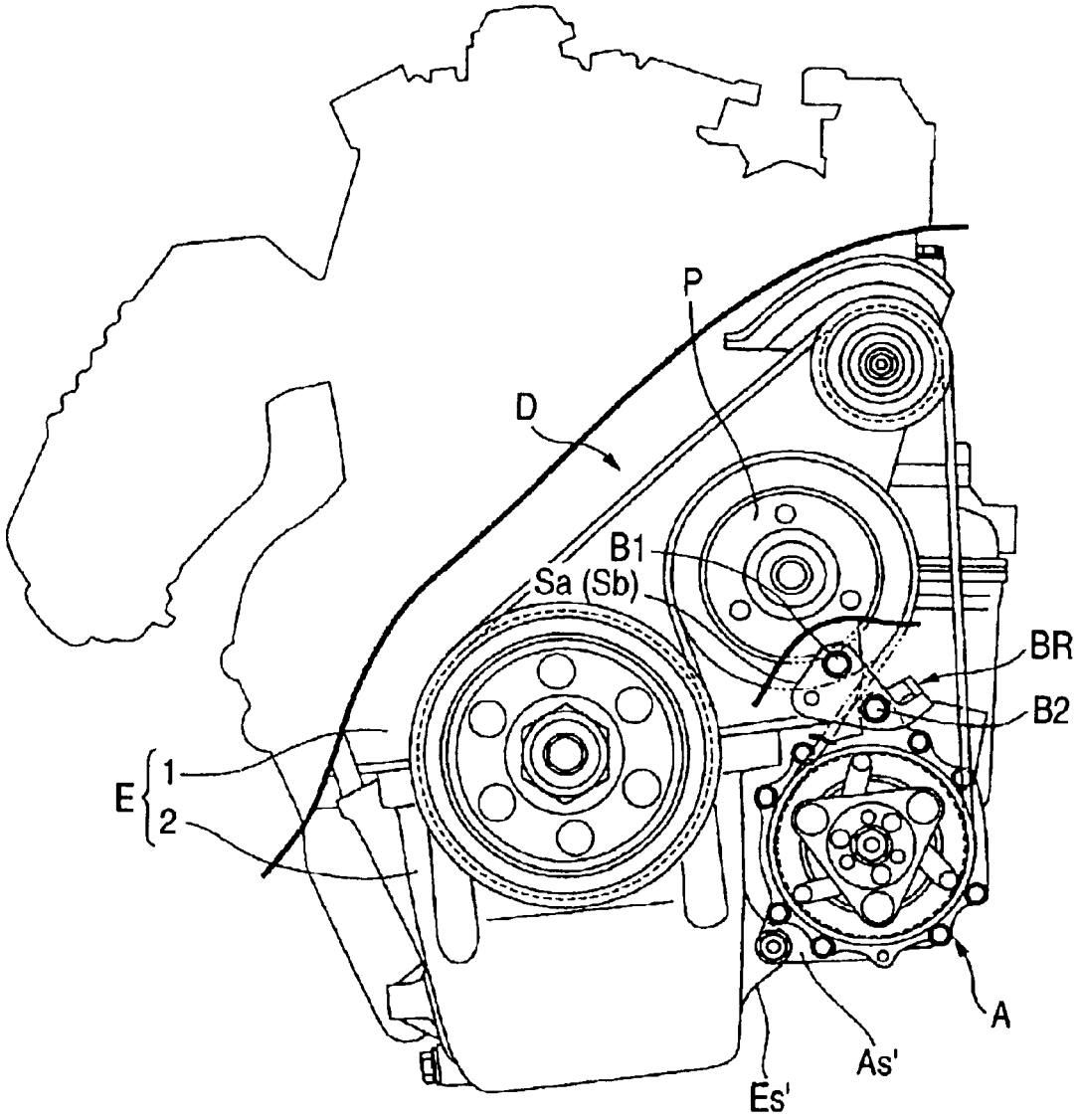
FIG. 1 is a front view showing the schematic construction of an engine according to an embodiment of the invention.

Firstly, in FIG. 1, a belt drive mechanism D for auxiliary equipment which is adapted to transmit the rotation of a crankshaft to an air conditioner compressor A and a coolant pump P is disposed on an engine mounted in a front part of a body of an automobile (not shown) at one end portion of an engine main body E. The compressor A as auxiliary equipment is detachably mounted to the engine main body E using a mounting construction of the invention, which will be described specifically below.

Figure 2:
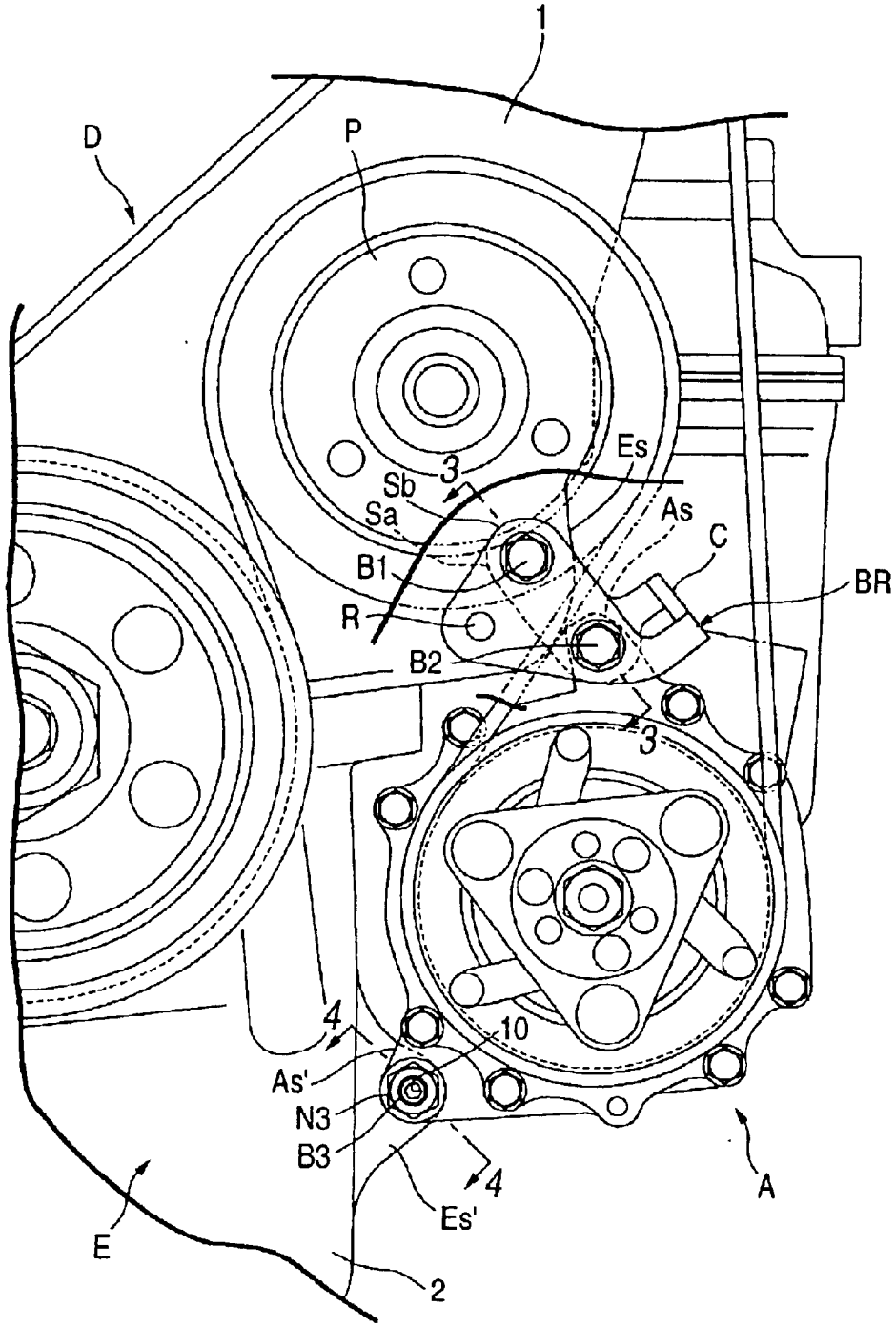
FIG. 2 is a partially cut-away enlarged view of FIG. 1.
Figure 3:
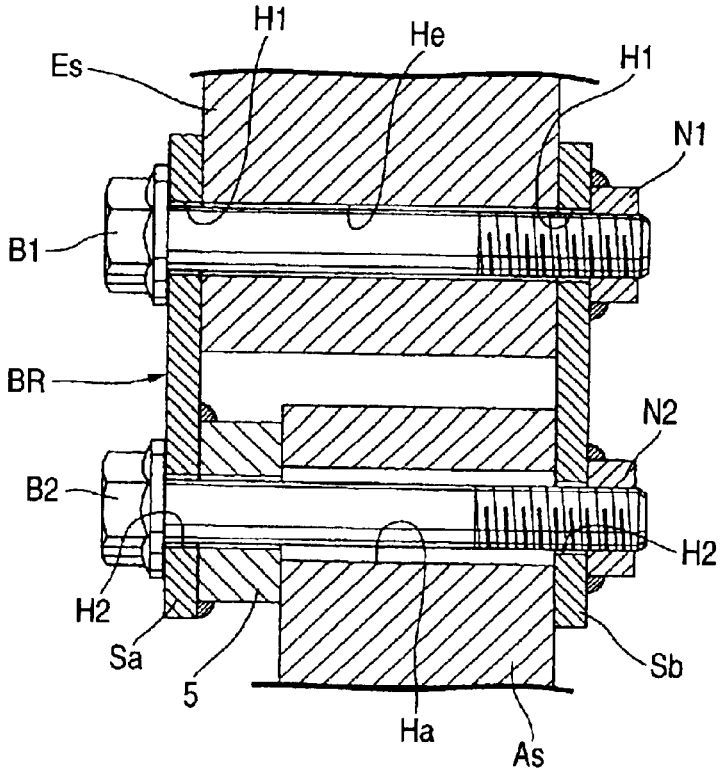
FIG. 3 is an enlarged sectional view taken along the line 3—3 in FIG. 2.
Figure 4:
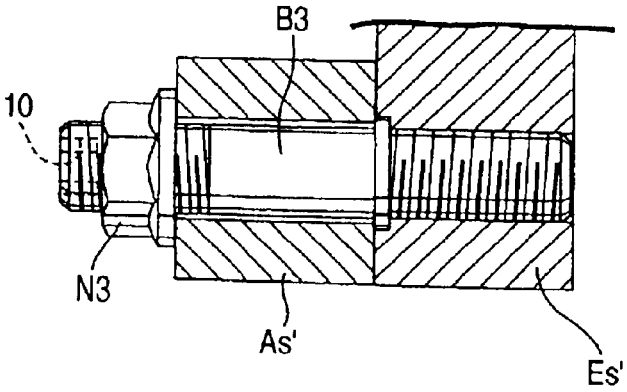
FIG. 4 is an enlarged sectional view taken along the line 4—4 in FIG. 2.

Referring to FIGS. 2 to 4 together, the engine main body E comprises a cylinder block 1 and an oil pan 2 which is detachably joined to a lower side of the cylinder block 1. A first support portion Es, which is raised in an angle-like fashion from an external side of the cylinder block 1 and formed into a relatively wide boss-like configuration, is provided integrally on the exterior side of the cylinder block 1 at one end thereof in such a manner as to protrude therefrom, and a plate-like second support portion Es' is provided on the exterior side of the oil pan 2 on one side thereof. Thus, the first support portion Es constitutes a support portion according to the invention.

In addition, the compressor A includes a first supported portion As and a second support portion As' integrally and projectedly formed on exterior sides thereof which confront the engine main body E. The first supported portion As is raised in an angular fashion from the exterior side of the compressor A and is formed into a relatively wide boss-like configuration. And, the first supported portion As is disposed close to and in parallel with the first support portion Es. The second supported portion As' is formed in a plate-like configuration, and overlaps the second support portion Es'. Thus, the first supported portion As constitutes a supported portion according to the invention. Note that while the first supported portion As is formed narrower than the first support portion Es in the illustrated embodiment, the both portions may be formed to have the same width.

The first support portion Es on the engine main body E and the first supported portion As which is arranged on the compressor A in such a manner as to be in parallel with the first support portion Es are connected to each other by an auxiliary equipment bracket BR which is tightened to the first support portion Es and the supported portion As with two first and second bolts B1, B2 in such a manner as to interpose the both portions Es, As from both sides thereof.

In addition, the second support portion Es' on the engine main body E and the second supported portion As' on the compressor A which overlaps the second support portion Es' are connected together with a stud bolt B3 and a nut N3. The stud bolt B3 is screwed and planted in the support portion Es' and passes through the supported portion As'. The nut N3 is screwed on a leading portion of the stud bolt B3 (refer to FIG. 4). An engaged portion (for example, as shown in the illustrated example, a hexagonal hole 10 and a polygonal protrusion of a torques type) with which a rotational tightening tool can be brought into engagement is formed at a distal end of the stud bolt B3 considering the attachment and removal of the compressor A to and from the engine mounted on the vehicle.

Figure 5:
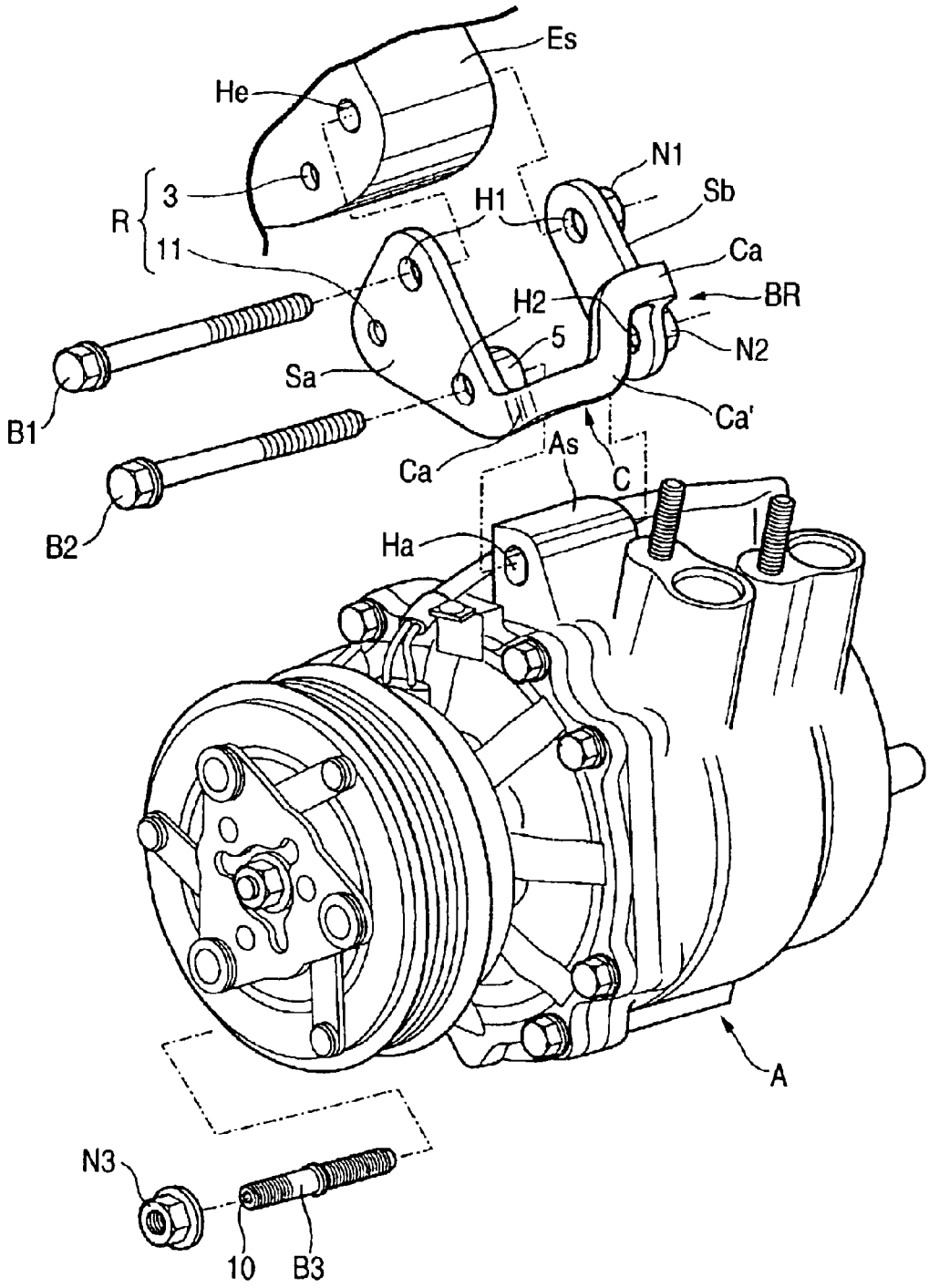
FIG. 5 is an exploded perspective view showing an auxiliary equipment bracket and a peripheral portion thereof.

Next, referring to FIGS. 3, 5, the specific construction of the bracket BR will be described. The bracket BR is formed into a substantially U-shaped configuration having a pair of parallel left and right plate-like stays Sa, Sb and a plate-like connecting portion C. The plate-like stays Sa, Sb extend in a direction in which the first support portion Es and the first supported portion As are arranged in parallel with each other, and face each other in such a manner as to hold the support portion Es and the supported portion As therebetween. The plate-like connecting body C integrally connects both the stays Sa, Sb at end portions thereof which are away from the first support portion Es at the outside of the first supported portion As. In the illustrated example, the bracket BR is formed by press forming a sheet metal such a sheet steel.

To deal with the fact that the first supported portion As is formed narrower than the first support portion Es as is described above, a spacer 5 such as a collar of a thickness corresponding to a difference in width between the two portions is secured to an interior side of at least one of the stays or the stay Sa by virtue of welding or the like. According to the spacer 5 so formed, since a gap generated between the stay Sa and the first supported portion As by the difference in width between the first supported portion As and the first support portion Es or deviation in position between sides thereof can be absorbed accurately, the first supported portion As and the first support portion Es can be accurately interposed between the two stays Sa, Sb. Note that a stepped portion which has a height equal to the difference in width may be integrally formed on one of the stays or the stay Sa, instead of the spacer 5.

In a state in which the bracket BR is in a free condition, the space between the confronting faces of the pair of left and right stays Sa, Sb is set slightly greater than the respective widths of the first support portion Es and the first supported portion As (in the illustrated example, in the order of 0.1 to 1.0 mm). With this space, the first support portion Es and the first supported portion As can be easily interposed between the two stays Sa, Sb during an assembling process, thereby increasing the efficiency in the assembling work, and moreover there is caused no problem in the assembling work by a detent unit R which is specially provided, the detent unit being described later. In addition, the relative gap between the two stays Sa, Sb is set 15 mm or greater in order to secure a sufficient supporting span of the stays Sa, Sb relative to the first support portion Es and the first supported portion As to thereby secure a required mounting rigidity for the bracket BR.

A first bolt passing hole H1 is formed in each of the left and right stays Sa, Sb so that the first tightening bolt B1 is allowed to pass through the first support portion Es between the respective stays Sa, Sb. Then, an engine-side bolt hole He is formed in the first support portion Es on the engine main body E in such a manner as to coincide with the first bolt passing hole H1, so that the bolt B1 is allowed to pass therethrough.

In addition, a second bolt passing hole H2 is formed in each of the left and right stays Sa, Sb at a position closer to the connecting body than the first bolt passing hole H1, so that the tightening bolt B2 is allowed to pass through the first supported portion As between the respective stays Sa, Sb. Then, a compressor-side bolt hole Ha is formed in the first supported portion As on the compressor A in such a manner as to coincide with the second bolt passing hole H2, so that the bolt B2 is allowed to pass therethrough. This compressor-side bolt hole Ha is formed into an elongate hole which is brought into tight contact (namely, there is caused no play) with the bolt B2 in a radial direction about the detent unit R, which will be described later, whereby the positioning accuracy of the compressor A relative to the engine main r) body E can be increased. In addition, the compressor tightening position of the bolt B2 is adapted to be adjusted slightly in a direction along the elongate hole.

A detent unit R is provided between at least one of the stays (in this illustrated example, the left stay Sa) and the engine main body E (the cylinder block 1), for preventing the entrained rotation of the bracket BR that would occur when tightening the first tightening bolt B1 which extends through the first support portion Es between the respective stays Sa, Sb. In the illustrated example, this detent unit R comprises a detent pin 11 formed on at least one of the stays (in the illustrated example, the left stay Sa) in such a manner as to protrude inwardly and a detent hole 3 formed in the first support portion Es on the cylinder block 1 in such a manner as to closely fit on the protruding detent pin 11. In addition, in a case where the bracket BR (the left stay Sa) is a press formed article, the detent pin 11 may be formed integrally at the same time of press forming the bracket BR, or the pin may be produced separately from the left stay Sa and thereafter be attached to the stay Sa.

In addition, first and second nuts N1, N2 are secured to the other stay (in the illustrated example, the right stay Sb) so that the first and second bolts B1, B2, which are through bolts, are screwed thereinto, whereby the number of components can be reduced.

At least one bent portion Ca, Ca (in the illustrated example, at two positions in the vicinity of the ends of the connecting body C, respectively) is formed on the connecting body C so that the relative displacement between the ends of the connecting body C that would occur in association with tightening the respective bolts B1, B2 can be permitted by virtue of its elastic deformation. Consequently, even if the space between the two stays Sa, Sb in the state in which the connecting bracket BR is in a free condition is set slightly wider, considering the assembling work, the relative displacement that would occur between the ends of the connecting body C in association with tightening the bolts B1, B2 can be reasonably permitted through its elastic deformation (namely, there is caused no stress concentration on the respective potions of the connecting body C). Therefore, in conjunction with the effect that the respective stays Sa, Sb themselves are formed into sheets to have slight elasticity to obtain a good following property with respect to the interposed faces, the respective stays Sa, Sb may be allowed to follow reasonably easily the corresponding faces of the first support portion Es and the supported portion As, whereby the first support portion Es and the supported portion As can be accurately interposed between the two stays Es, As.

Furthermore, another bent portion Ca' is also formed at an intermediate portion of the connecting body C so that piping in the vicinity of the compressor A, a tool line or a assembly fixture may be allowed to be escape therefrom. In addition, according to the bent portion Ca', since the actual overall length of the connecting member C becomes longer, in conjunction with the special provision of the bent portions Ca, Ca at the ends of the connecting body C, as has been described before, the elastic deformation associated with tightening the bolts B1, B2 may be allowed to occur more reasonably.

Next, the operation of the embodiment will be described. In assembling the compressor A to the engine main body E, the second supported portion As' at the lower portion of the compressor A is temporarily fastened to the second support portion Es' on the engine main body E (the oil pan 2) side with the stud bolt B3 and the nut N3, while the first support portion Es on the engine main body E (the cylinder block 1) side is fastened between the two stays Sa, Sb of the bracket BR with the first bolt B1, whereby the bracket BR can be fixed to the engine main body E in advance. In this case, since the entrained rotation of the bracket BR is securely prevented by the detent unit R when tightening the first bolt B1, the good workability can be obtained.

Next, the compressor A is rotated upwardly around the stud bolt B3, so that the first supported portion As thereof approaches and is juxtaposed with the first support portion Es on the engine main body E side so as to be held between the left and right stays Sa, Sb. In this condition, the second bolt B2 is tightened to thereby tightly fasten the first supported portion As between the two stays Sa, Sb. In addition, when the compressor A is rotated upwardly, most of the tare weight thereof is supported on the engine main body E side via the third bolt B3, and moreover, the connecting body C is formed in such a manner as to escape from the rotational locus of the first supported portion As, whereby there is caused no risk that the connecting body C interferes with the first supported portion As, thereby making is possible to smoothly rotate the compressor A upwardly with no problem.

Thereafter, the nut N3 is screwed and tightened on the stud bolt B3, whereby the second supported portion As' at the lower portion of the compressor A can be tightened to the second support portion Es' on the engine main body E (the oil pan) side via the bolt B3 and the nut N3, thus completing a series of mounting work of the compressor A to the engine main body E.

In mounting the compressor A as the auxiliary equipment to the engine main body E via the bracket BR as has just been described above, the first support portion Es of the engine main body E and the first supported portion As of the compressor A are made to approach each other and to be juxtaposed with each other. Then, the both portions Es, As are held between the pair of left and right stays Sa, Sb of the bracket BR, and only have to be fastened therebetween with the respective bolts B1, B2, thus the good workability being obtained. Moreover, since this bracket BR is constituted by the pair of left and right stays Sa, Sb adapted to be tightened by the respective bolts B1, B2 with the first support portion Es and the first supported portion As being fastened therebetween and the connecting body C which connects integrally the one ends of the respective stays Sa, Sb, the number of tightening bolts B1, B2 that have to be used can be limited to a minimum possible number, and the both stays Sa, Sb are made integral via the connecting body C, namely, are made to be integrated into a single component. Thus, when compared with the conventional auxiliary equipment bracket, as a whole, the numbers of components and assembling man hours can be reduced.

In addition, since the first support portion Es and the first supported portion As are interposed from the sides thereof by the pair of left and right stays Sa, Sb so as to be connected to each other integrally, the engine main body E (the first support portion Es) itself and the compressor A (the first supported portion As) itself are constructed to be part of the bracket BR to thereby reinforce the bracket B effectively. Thus, even if the bracket is formed of a sheet material of a relatively small thickness to aim to reduce the size and weight of the bracket, the required connecting strength between the engine main body E and the compressor A by the bracket BR can be secured. Moreover, according to the interposing construction of the substantially U-shaped bracket BR relative to the first support portion Es and the first supported portion As, since most part of the bracket BR can be made to overlap the first support portion Es and the first supported portion As, the compressor A is allowed to approach as close to the engine main body E as possible, whereby the size and weight of the engine can be reduced. Thus, the auxiliary equipment mounting construction according to the invention becomes advantageous in mounting the engine in an actual vehicle, as well as in increasing the safety in collision.

In addition, in the illustrated example, since the end portions of the two stays Sa, Sb on the compressor A side is integrally connected to each other through the connecting body C at the outside of the supported portion As of the compressor A, the support of the compressor A by the bracket BR is made strong, and therefore, the auxiliary equipment mounting construction of the invention is also advantageous in suppressing the vibrations and noise from the compressor A.

Thus, while the embodiment of the invention has been described in detail heretofore, the invention is not limited to the above embodiment, but may be variously modified in design.

For example, in the embodiment, while the first tightening bolt B1 and the second tightening bolt B2 are described as functioning as the through bolts which pass through the support portion Es and the supported portion As to tighten the two stays Sa, Sb together, in the invention, internal threads may be formed in the support portion Es and the supported portion As, respectively, so that the respective stays Sa, Sb are tightened to the support portion Es and the supported portion As with separate bolts.

In addition, in the embodiment, while the bracket BR is described as being formed integrally by press forming the entirety thereof, in the invention, the bracket BR may be constituted by a plurality of elements which are produced separately, and thereafter the elements are connected integrally to each other in a retrofit fashion to thereby produce a bracket BR.

Furthermore, in the embodiment, while the detent unit R is described as being constituted by the detent pin 11 provided on one of the stays or the stay Sa and the detent hole 3 formed in the engine main body E side so as to be brought into engagement with the detent pin 11, conversely, the detent hole may be formed in the stay Sa side whereas the detent pin may be provided on the engine main body E side. Moreover, the detent unit may be constituted by other recessed and raised unit provided between the stay Sa and the engine main body E.

In addition, in the embodiment, while the spacer 5 or the difference in level is provided on the interior side of one of the stays or the stay Sa to fill the gap generated between the confronting faces of the stay Sa and the first supported portion As by the difference in width between the first supported portion As and the first support portion Es or the deviation in position of the sides thereof, in a case where the gap is generated between the confronting faces of one of the stays or the stay Sa and the first supported portion As due to the difference in width between the first supported portion As and the support portion Es, the spacer or the difference in level may be provided on the interior face of the stay Sa so as to correspond to the first support portion Es. In addition, in a case where the first supported portion As and the first support portion Es are identical to each other in width and the position of the sides thereof are registered with each other, the spacer and the difference in level may both be omitted.

As has been described heretofore, according to the first aspect of the invention, since the auxiliary equipment bracket for mounting auxiliary equipment to the engine main body is constituted by the pair of stays adapted to be bolt tightened with the support portion of the engine main body and the supported portion of the auxiliary equipment being interposed therebetween and the connecting body which connects integrally between the end ends of the pair of stays, not only can the number of bolts that have to be used can be limited to the minimum number but also the two stays can be made to be a single component with the connecting body being interposed therebetween. Consequently, as a whole, the numbers of components and man hours required for assembling can be largely reduced, this largely contributing the reduction in production costs. Additionally, since the support portion on the engine main body and the supported portion on the auxiliary equipment which is arranged in parallel with the support portion are interposed from the sides thereof by the pair of stays and connected together with the bolts, the engine main body and the auxiliary equipment themselves are constructed to additionally constitute part of the bracket, whereby the bracket is reinforced effectively and the reduction in size and weight of the bracket can be attained. Moreover, the auxiliary equipment is allowed to approach as close to the engine main body as possible without being interrupted by the bracket. Thus, these features contribute to the reduction in size and weight of the engine.

In addition, according to the second aspect of the invention, since the bolts can be tightened while ensuring that the entrained rotation of the auxiliary bracket is prevented when tightening the tightening bolts between the respective stays and the support portion, the efficiency in the assembling work can be improved.

Furthermore, according to the third aspect of the invention, since the number of bolts that have to be used can be reduced further and the tightening operation of the respective bolts to the two stays can be implemented collectively, simply and quickly, the efficiency in the assembling work can be improved, and the number of components can further be reduced.

Moreover, according to the fourth aspect of the invention, since the relative displacement at the ends of the connecting body in association with tightening the bolts is constructed to be reasonably permitted by virtue of the elastic deformation of the bent portion of the connecting body, even if the gap between the two stays is set slightly wider in the state in which the bracket is in the free condition, considering the assembling workability, the respective stays are allowed to easily follow and is brought into close contact with the support portion and the supported portion, whereby the support portion and the supported portion can be accurately interposed between the two stays.

What is claimed is:

1. An engine auxiliary equipment mounting construction comprising:

a support portion formed on an engine main body;

a supported portion formed on an auxiliary equipment so that the supported portion is juxtaposed with said support portion; and an auxiliary equipment bracket connecting said support portion with said supported portion, said auxiliary equipment bracket being formed into a substantially U-shape with a pair of stays and a connecting body, said pair of stays extending in a direction in which said support portion and said supported portion are juxtaposed with each other and facing each other to hold said support portion and said supported portion therebetween, said connecting body integrally connecting between said stays, wherein each of said stays defines a first bolt passing hole through which a first tightening bolt is allowed to pass to tighten between said stay and said support portion and a second bolt passing hole parallel to said first bolt passing hole through which a second tightening bolt is allowed to pass to tighten between said stay and said supported portion.

2. The engine auxiliary equipment mounting construction as set forth in claim 1, wherein a detent unit is provided between at least one of said stays and said engine main body, for preventing the entrained rotation of said auxiliary equipment bracket, which occurs when tightening said tightening bolt between said stay and said support portion.

3. The engine auxiliary equipment mounting construction as set forth in claim 1, wherein said auxiliary equipment bracket is structured by a plate member.

4. The engine auxiliary equipment mounting construction as set forth in claim 1, wherein said supported portion of said auxiliary equipment defines an elongate hole through which said second tightening bolt is allowed to passed.

5. The engine auxiliary equipment mounting construction as set forth in claim 1, wherein said tightening bolt for tightening the connection between said stays and said supported portion is a single through bolt which passes through said supported portion and said second bolt passing holes formed in said respective stays.

6. The engine auxiliary equipment mounting construction as set forth in claim 1, wherein each of said stays has a plate shape.

7. An engine auxiliary equipment mounting construction comprising:

a support portion formed on an engine main body;

a supported portion formed on an auxiliary equipment so that the supported portion is juxtaposed with said support portion; and an auxiliary equipment bracket connecting said support portion with said supported portion, said auxiliary equipment bracket being formed into a substantially U-shape with a pair of stays and a connecting body, said pair of stays extending in a direction in which said support portion and said supported portion are juxtaposed with each other and facing each other to hold said support portion and said supported portion therebetween, said connecting body integrally connecting between said stays, wherein each of said stays defines a first bolt passing hole through which a first tightening bolt is allowed to pass to tighten between said stay and said support portion and a second bolt passing hole through which a second tightening bolt is allowed to pass to tighten between said stay and said supported portion, wherein said first tightening bolt for tightening the connection between said respective stays and said support portion is a single through bolt which passes through said support portion and said first bolt passing holes formed in said respective stays, wherein said tightening bolt for tightening the connection between said stays and said supported portion is a single through bolt which passes through said supported portion and said second bolt passing holes formed in said respective stays, and wherein respective nuts are secured to one of said stays so that said respective bolts are screwed thereinto.

8. An engine auxiliary equipment mounting construction comprising:

a support portion formed on an engine main body;

a supported portion formed on an auxiliary equipment so that the supported portion is juxtaposed with said support portion; and an auxiliary equipment bracket connecting said support portion with said supported portion, said auxiliary equipment bracket being formed into a substantially U-shape with a pair of stays and a connecting body, said pair of stays extending in a direction in which said support portion and said supported portion are juxtaposed with each other and facing each other to hold said support portion and said supported portion therebetween, said connecting body integrally connecting between said stays, wherein each of said stays defines a first bolt passing hole through which a first tightening bolt is allowed to pass to tighten between said stay and said support portion and a second bolt passing hole through which a second tightening bolt is allowed to pass to tighten between said stay and said supported portion, and wherein said connecting body includes a bent portion for permitting a relative displacement between ends of said connecting body in association with tightening said respective bolts.

* * * * *